United States Patent [19]

Crain

[11] 4,043,424

[45] Aug. 23, 1977

[54] KNEELING APPARATUS FOR CEMENT MASONS

[76] Inventor: Auther Lee Crain, 9805 Anderson Mill Road, Austin, Tex. 78759

[21] Appl. No.: 693,425

[22] Filed: June 7, 1976

[51] Int. Cl.[2] ..... E04G 1/00; A43B 3/00

[52] U.S. Cl. ..... 182/230; 36/113

[58] Field of Search ..... 36/1, 136, 113; 2/24; 182/230; 297/391

[56] References Cited

U.S. PATENT DOCUMENTS

| | | | |
|---|---|---|---|
| 3,084,458 | 4/1963 | Ramon | 36/1 |
| 3,499,502 | 3/1970 | Rosander | 182/230 |

FOREIGN PATENT DOCUMENTS

| | | | |
|---|---|---|---|
| 374,512 | 6/1932 | United Kingdom | 182/230 |

*Primary Examiner*—Patrick D. Lawson

*Attorney, Agent, or Firm*—Roylance, Abrams, Berdo & Kaul

[57] ABSTRACT

Disclosed is an improved kneeling apparatus for cement masons which allows substantially unencumbered movement across large expanses of unset cement surfaces while simultaneously providing ample support to eliminate marring and pocking of finished surfaces. The apparatus includes a pair of spaced-apart platforms, each containing peripherally disposed upstanding side walls and an extending handle. Each platform surface is adapted to interchangeably accept the knees or the feet of the user. A mason, while working wet unfinished cement, can shift and otherwise distribute his weight such that one or the other of the surfaces can be lifted and moved by means of the handle, without upsetting or divoting the unset surface.

6 Claims, 9 Drawing Figures

KNEELING APPARATUS FOR CEMENT MASONS

BACKGROUND OF THE INVENTION

1. Field of the Invention

This invention relates to devices for supporting working masons on an unset flooring surface and more particularly to kneeling devices for cement masons which provide support, while simultaneously allowing unencumbered movement.

2. Prior Art

There are many types of craftsmen who must spend considerable time in the kneeling position because of the nature of the work performed. There are many devices presently available to provide knee protection and comfort to the kneeling craftsman. Among these are knee pads, padded movable supports, wheeled carriages and the like. For example, knee pads such as those disclosed in U.S. Pat. No. 1,761,093 and U.S. Pat. No. 1,055,040, form a padded bucket which is strapped directly to the wearer's knee. Other devices employ complicated slings and carriages which are adapted to receive the user's leg. These devices are strapped or otherwise secured to the leg or trousers of the wearer. Some are hinged to allow movement to and from the kneeling position.

The cement masons encounter unique problems in finishing uncured cement surfaces. Specifically, the mason must kneel on a wet, partially cured surface in order to trowel, finish and otherwise work the unset material. Kneeling directly upon the unset surface is unsatisfactory. The knee and the ball of the shoes of the user's foot gouge, sink, and otherwise become lodged in the surface. In addition, long hours of kneeling directly on the surface is unpleasant and uncomfortable.

The devices used to protect other workmen who must kneel in performing their work are, for the most part, unsatisfactory for the cement mason. Knee pads or padded buckets attached directly to the knee do not provide sufficient surface area to prevent penetration of the unfinished surface. Additionally, the pressurized contact of the outer surface of the pad with the unset material creates an evacuated seal directly beneath the pad surface. Since the pad is secured to the user's leg, it is particularly difficult for the mason to change positions without much effort and the possibility of gouging or "divoting" the surface.

More complicated and cumbersome devices, such as those disclosed in U.S. Pat Nos. 2,627,301, 2,719,576 and 3,084,458 provide sufficient surface area. However, the evacuated seal created by contact of these prior art devices with the wet, unset surface makes movement virtually impossible. Since the devices are attached directly to the leg of the user, attempts at movement are awkward as well as fatiguing. Breaking this seal, such as by movement of the device, tends to gouge and mar the cement surface. As the device is pulled from the unset material, the bottom surface retains a large divot. This divot makes an indentation on the surface as the device is relocated.

It has now been discovered that a simple kneeling apparatus virtually eliminates the problem associated with heretofore known devices by allowing a mason virtually unrestricted access to work an unset surface without marring, gouging or coming into direct contact with the unset surface.

Two interchangeable platforms independently support both knees and both feet of the user, respectively. The platforms are not attached to the user's person, allowing unencumbered movement and diminishing fatigue. The platforms are easily moved and relocated by means of attached handles. The handles also allow the tilting of the platform during relocation in such a manner as to break any created suction, thus preventing a divot in the unset surface. The mason can shift and otherwise distribute the whole of his weight to one or the other of the platforms, thus freeing the non-load bearing platform for easy relocation by means of the handle. Thus, the mason can traverse and work the unfinished surface in a substantially unencumbered manner.

SUMMARY OF THE INVENTION

According to the broad aspects of the instant invention, there is provided a kneeling apparatus which includes means for independently supporting the knees and the feet of a user and handle means attached to the independent support means. In one aspect, a pair of spaced-apart platforms is positioned in such a relationship so that a first platform accepts the knees of the user, while a second platform accepts the user's feet. Each platform contains an upstanding handle adapted for moving or relocating the platform.

In a preferred embodiment, each platform has a trapezoidal configuration containing a rigid handle affixed at the truncated end and having a slightly crowned bottom surface with rolled, peripherally disposed upstanding side walls.

BRIEF DESCRIPTION OF THE DRAWINGS

The advantages of the present invention will be readily apparent and appreciated by those of ordinary skill in the art, as the same becomes better understood by reference to the following detailed description when considered in connection with the accompanying drawings, in which.

DESCRIPTION OF THE PREFERRED EMBODIMENT

Figure 1:
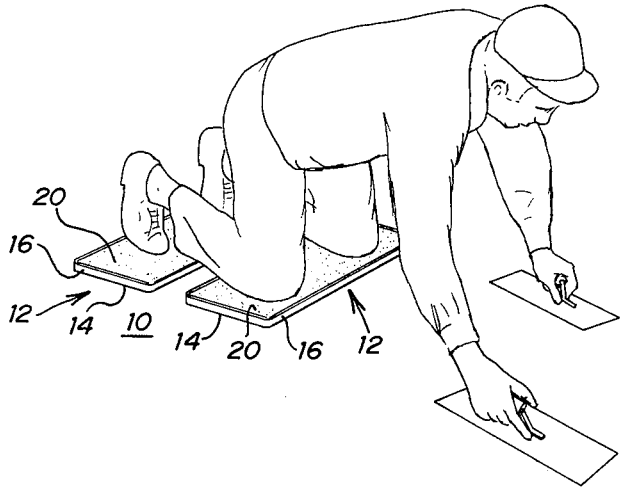
FIG. 1 is the perspective view of the apparatus of in instant invention in use.

Referring now to the drawings, with like reference characters designating like or corresponding parts throughout the several views, there is illustrated in FIG. 1 the kneeling apparatus of the instant invention. The entire kneeling apparatus, which will be generally designated by reference numeral 10 for purpose of description, comprises two platforms or trays 12 which are preferably identical one to the other, as shown in FIG. 1. Each tray 12 has a bottom surface or base portion 14 and a peripherally disposed upstanding side wall or lipped portion 16, which together constitute the shell of the platform 12 and form a contained volume. An extending handle 18 (not shown in FIG. 1) is rigidly attached to the base 14. The top surface of base 14, i.e. the contained volume formed by the base 14 in cooperation with the upstanding side wall 16, is covered with a suitable resilient material 20, such as polyurethane and the like, in order to provide greater comfort for the user.

Figure 2:
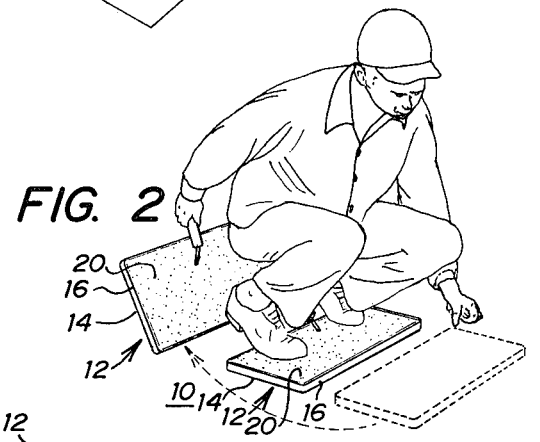
FIG. 2 is an illustrative view of one position of the user with respect to the apparatus of the instant invention when one platform is being moved.

In use, the two platforms are horizontally disposed in a spaced-apart relationship so as to independently accept the knees and feet of the user, as is shown in FIG. 1. When the area in front of the mason has been troweled or otherwise finished, the mason is able to pivot or roll backward, thereby placing all his weight in the single rearwardly disposed platform, as shown in FIG. 2. By means of the handle 18, the mason then is able to move the non-load bearing platform from the forwardly disposed position (shown in phantom in FIG. 2) to the rear. The mason then steps onto the relocated platform. Thus, the platform which was initially forwardly disposed becomes the rearwardly disposed platform. The platforms are thus repositioned into the space-apart relationship and the mason is ready to trowel or finish previously unfinished areas.

In accordance with the instant invention, the two platforms need not be identical in configuration nor need they contain the upstanding side walls. The only requirement is that each contain a handle means for relocation and sufficient surface area to adequately support the weight of the mason without unduly indenting or marring the surface.

Platforms having a surface area from about 1 sq. ft. to about 3 sq. ft. have been found sufficient. The exact area will depend on the unset surface to be finished, the weight of the mason and the like. Preferably the platforms are identical in configuration, being completely interchangeable one with another in use. It will further be realized that more than two platforms can be utilized in accordance with the instant inventive concept; however, two is the minimum number that can be effectively utilized.

Figure 3:
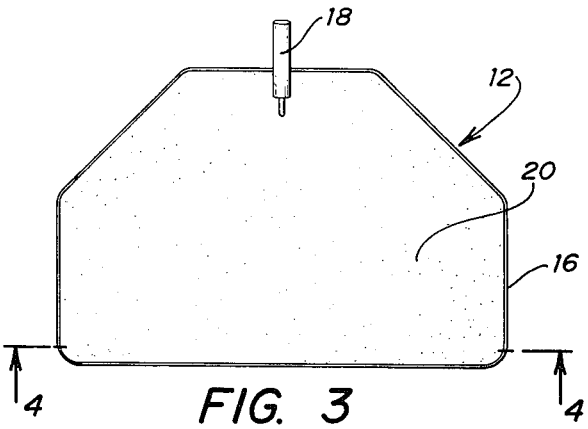
FIG. 3 is a top view of a preferred embodiment of one platform of the apparatus of the instant invention.
Figure 5:
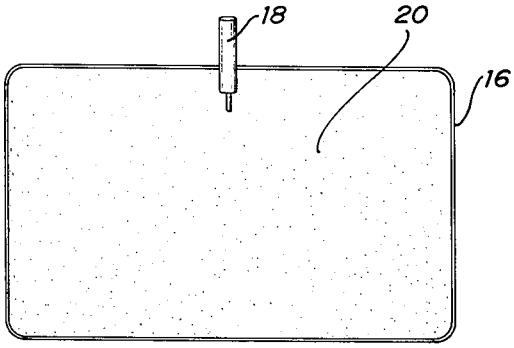
FIG. 5 is a top view of another embodiment in accordance with the instant invention.
Figure 6:
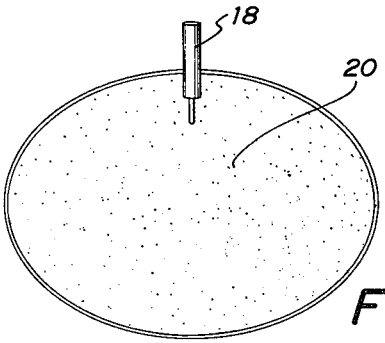
FIG. 6 is a top view of a further embodiment in accordance with the instant invention.
Figure 7:
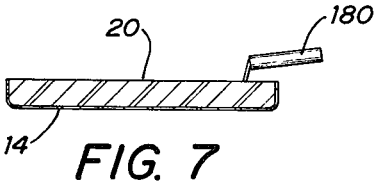
FIG. 7 is an end view of a platform which illustrates a preferred handle.

Each platform contains a handle means for relocating the platform in use. The handle is attached to the platform in a manner to allow easy relocation of the platform. Preferably the handle is permanently mounted by riveting and the like. As shown in FIG. 7, a preferred handle 180 extends upwardly and outwardly from the platform. The handle is preferably positioned as shown in FIGS. 3, 5 and 6. The exact positioning of the handle is not critical; however, it will be realized that the handle should be positioned such as to allow unencumbered use of the platform by the mason.

The positioning of the handle also will depend upon the number of handles utilized, the shape of the platform and the like. Preferably, the handle is mounted at the rearward center portion of the platform. In the preferred trapezoidal configuration, the handle is mounted in the truncated portion of the platform. More than one handle can be attached to a single platform for a particular use or for convenience.

Figure 8:
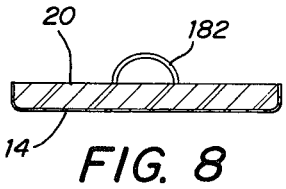
FIG. 8 is an end view which illustrates a handle in accordance with another embodiment of the instant invention.
Figure 9:
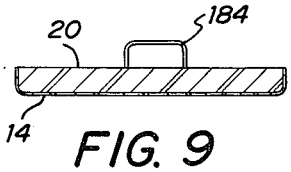
FIG. 9 illustrates a handle in accordance with a further embodiment of the instant invention.

FIGS. 8 and 9 show handles 182 and 184, respectively. Handle 182 comprises a flexible handle means, such as a strap or the like, which is mounted to the platform as previously described. Handle 184 is a grip-type or u-shaped rigid handle which is similarly mounted. It will be realized that any type of extended gripping device can be utilized in accordance with the instant inventive concept. Additionally, the handle may be attached in any manner so as to provide the required leverage to move and relocate the platform. In another embodiment, not shown, the handles may be detachably mounted on the platform so that they may be removed for storage, etc.

Figure 4:
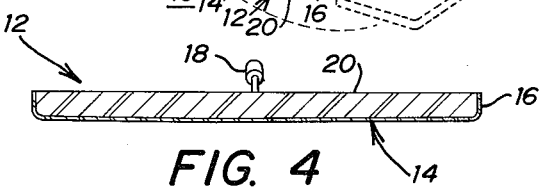
FIG. 4 is an end view of the apparatus through 4—4 in FIG. 3.

Preferably the platforms, in accordance with the kneeling apparatus of the instant invention, include a base 14 with a peripherally disposed upstanding lip or side wall 16, which forms a contiguous surface. The height of the side wall or lip is not critical and will depend upon the unset surface, the weight of the mason and the surface area of the platform. A 1 inch side wall has been found sufficient. Three-fourths inch side walls are preferred. As shown in FIG. 4, preferably the base 14 is slightly curved or crowned. Although not required, the convex curvature has been found to substantially decrease the presence of the suction created under the platform when in contact with the unset cement surface. The upstanding side walls form a contiguous beveled surface with the base. The beveling is preferably for preventing gouging of the cement when the platform is rolled or rotated forward by means of the handle, in order that the platform might be moved.

The volume formed by the base 14 and the upstanding side walls 16 preferably contains a resilient filler material 20. It will be realized that such material is not critical but is provided merely for comfort to the user.

FIGS. 5 and 6 show other preferred configurations of the platforms in accordance with the instant invention. FIG. 5 shows a standard rectangular configuration, whereas FIG. 6 shows an oval configuration.

In order to most effectively utilize the apparatus of the instant invention, the handle is preferably rigid so that it may be used as a lever to roll the platform forward or backward on the base and thus break the suction beneath the platform with a rolling motion which prevents gouging and marring of the unset surface. It will become apparent to those skilled in the art that the platforms may be used in various combinations and the method and motion of movement in repositioning the device is not critical.

The platforms can be made of any suitable material, such as wood, metal, plastic or the like. Constructing the platform of wood, however, is not preferred, since wood tends to soak up water present, causing the platforms to swell, warp or otherwise become disfigured.

While the invention has been explained in relation to its preferred embodiments, it is to be understood that various modifications thereof will become apparent to those skilled in the art upon reading the specification and is intended to cover such modifications as fall within the scope of the appended claims.

What is claimed is:

1. A kneeling apparatus comprising first and second platform means for independently supporting the knees and feet of a user;

first and second handle means fixedly attached to each of said platform means for relocating said platform means, one with respect to the other;

each of said platform means comprising a tray having upstanding peripheral side walls, said trays being usable in spaced-apart relation such that one of said trays receives the knees of the user and the other receives the feet of the user, each of said trays being generally trapezoidal in shape with said handle means being attached to the truncated end portion of each of said trays, respectively.

2. The kneeling apparatus of claim 1 wherein the base of said first and said second tray has a convex curvature.

3. A kneeling apparatus comprising:

a first platform, adapted to receive either both knees or both feet of a user and having a handle for relocating said first platform;

a second platform adapted to receive either both knees or both feet of a user, being in a spaced-apart relation with said first platform and having a handle for relocating said second platform;

each of said handles being an upstanding, rigid, gripping device rigidly attached to its associated platform, each of said first and second platforms comprising a slightly crowned bottom surface with rolled, peripherally-disposed, upstanding side walls wherein the contained volume formed by said bottom surface and said side walls is covered with a resilient material.

4. The kneeling apparatus of claim 3 wherein said first and said second platforms are substantially identical in shape.

5. The kneeling apparatus of claim 4 wherein said platforms are generally trapezoidal in shape and said handles are affixed in the truncated portion of the platforms.

6. A kneeling apparatus for use by cement masons comprising: first and second substantially identical trays, each of said trays including a generally flat bottom wall, and side walls integrally formed with and extending upwardly from the outer edges of said bottom wall, said side walls being joined to form a continuous peripheral edge wall around said bottom wall, the outer surface of the area of connection between said bottom wall and said edge wall forming a smooth, continuous curve, and a generally L-shaped handle extending upwardly from said bottom wall and outwardly above and beyond said edge wall;

said first and second trays being usable to support the knees and feet, respectively, of the mason, and, using said handles, being relatively relocatable by the mason across a work surface, each of the trays being alternately used for knee and then for foot support.

* * * * *